United States Patent [19]

Slaughter

[11] Patent Number: 4,860,704

[45] Date of Patent: Aug. 29, 1989

[54] HINGE VALVED ROTARY ENGINE WITH SEPARATE COMPRESSION AND EXPANSION SECTIONS

[76] Inventor: Eldon E. Slaughter, 9 Sachem Rd., Greenwich, Conn. 06830

[21] Appl. No.: 187,938

[22] Filed: Apr. 29, 1988

Related U.S. Application Data

[63] Continuation-in-part of Ser. No. 45,153, Apr. 30, 1987, Pat. No. 4,471,164, which is a continuation of Ser. No. 787,677, Oct. 15, 1985, abandoned.

[51] Int. Cl.[4] ..... F02B 53/00

[52] U.S. Cl. ..... 123/237

[58] Field of Search ..... 123/237, 248, 236, 238, 123/239; 418/118, 122

[56] References Cited

U.S. PATENT DOCUMENTS

| | | | |
|---|---|---|---|
| 900,668 | 10/1908 | Cottrell et al. . | |
| 948,248 | 2/1910 | Reaugh | 60/627 |
| 977,027 | 11/1910 | Massey | 418/118 |
| 1,019,177 | 3/1912 | Morton | 123/237 X |
| 1,091,132 | 3/1914 | Harford | 123/237 X |
| 1,101,794 | 6/1914 | Friend | 123/237 |
| 1,140,723 | 5/1915 | Eyck | 60/627 |
| 1,153,169 | 9/1915 | Miller | 123/237 |
| 1,180,099 | 4/1916 | Zuendt | 123/248 X |
| 1,222,475 | 4/1917 | Sears . | |
| 1,281,621 | 10/1918 | Marion | 123/237 |
| 1,320,953 | 11/1919 | Winn | 123/237 X |
| 1,369,070 | 2/1921 | Williams et al. | 123/248 X |
| 1,406,140 | 2/1922 | Anderson | 418/118 |
| 1,607,505 | 11/1926 | Bentley . | |
| 1,674,449 | 6/1928 | Riggs . | |
| 2,131,216 | 9/1938 | Brooke . | |
| 2,250,484 | 7/1941 | Jutting | 123/248 X |
| 2,583,633 | 1/1952 | Cronin | 123/237 X |
| 2,938,505 | 5/1960 | Quartier . | |
| 3,958,900 | 5/1976 | Ueno | 123/198 F X |
| 4,098,256 | 7/1978 | Sieck | 123/236 X |
| 4,106,472 | 8/1978 | Rusk . | |
| 4,137,890 | 2/1979 | Wohl | 123/248 X |
| 4,149,370 | 4/1979 | Vargas | 60/39.6 |
| 4,178,900 | 12/1979 | Larsen . | |
| 4,192,279 | 3/1980 | Maisch et al. | 123/198 DB X |
| 4,211,083 | 7/1980 | Ueno | 60/626 |
| 4,448,161 | 5/1984 | Tseng | 123/237 |
| 4,453,506 | 6/1984 | Ueda et al. | 123/198 DB X |
| 4,494,497 | 1/1985 | Uchida et al. | 123/198 DB X |
| 4,653,269 | 3/1987 | Johnson | 60/627 X |
| 4,658,779 | 4/1987 | Granado | 123/237 |

FOREIGN PATENT DOCUMENTS

| | | | |
|---|---|---|---|
| 204088 | 11/1908 | Fed. Rep. of Germany | 123/237 |
| 622734 | 6/1961 | Italy | 123/237 |
| 10206 | of 1914 | United Kingdom | 60/627 |

OTHER PUBLICATIONS

H. L. Solberg et al., *Elementary Heat Power,* New York: John Wiley & Sons, Inc., Nov. 1947, pp. 80–87.

*Primary Examiner*—Michael Koczo
*Attorney, Agent, or Firm*—Litman, McMahon & Brown

[57] ABSTRACT

A hinge valved rotary engine has separate compression and expansion chambers with respective smooth surfaced compression and expansion rotors mounted therein on a common engine shaft. The chambers are connected by a combustor unit which receives compressed air from the compression chamber, mixes fuel with the air, and ignites the mixture for communication to the expansion rotor to turn the shaft. Air is compressed by cooperation of a hinged compression valve which sealingly engages the compression rotor. A combustion valve is forced into sealing engagement with the expansion rotor by the pressure of the combustion gases such that the pressurized combustion gases force lobes of the expansion rotor to rotate. A tangentially vaned compressed air control valve in the combustion unit controls the timing of the release of the compressed air into the combustor unit. Tangentially vaned expansion rotor lobe seals are urged into contact with the peripheral surface of the expansion chamber by springs, by centrifugal force, and by exposure to the pressure of combustion gases in the expansion chamber.

10 Claims, 5 Drawing Sheets

Fig. 1.
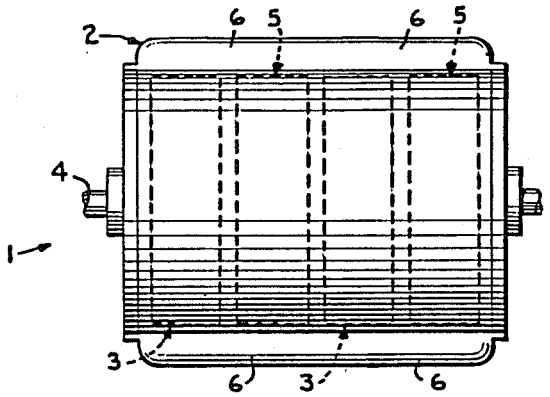
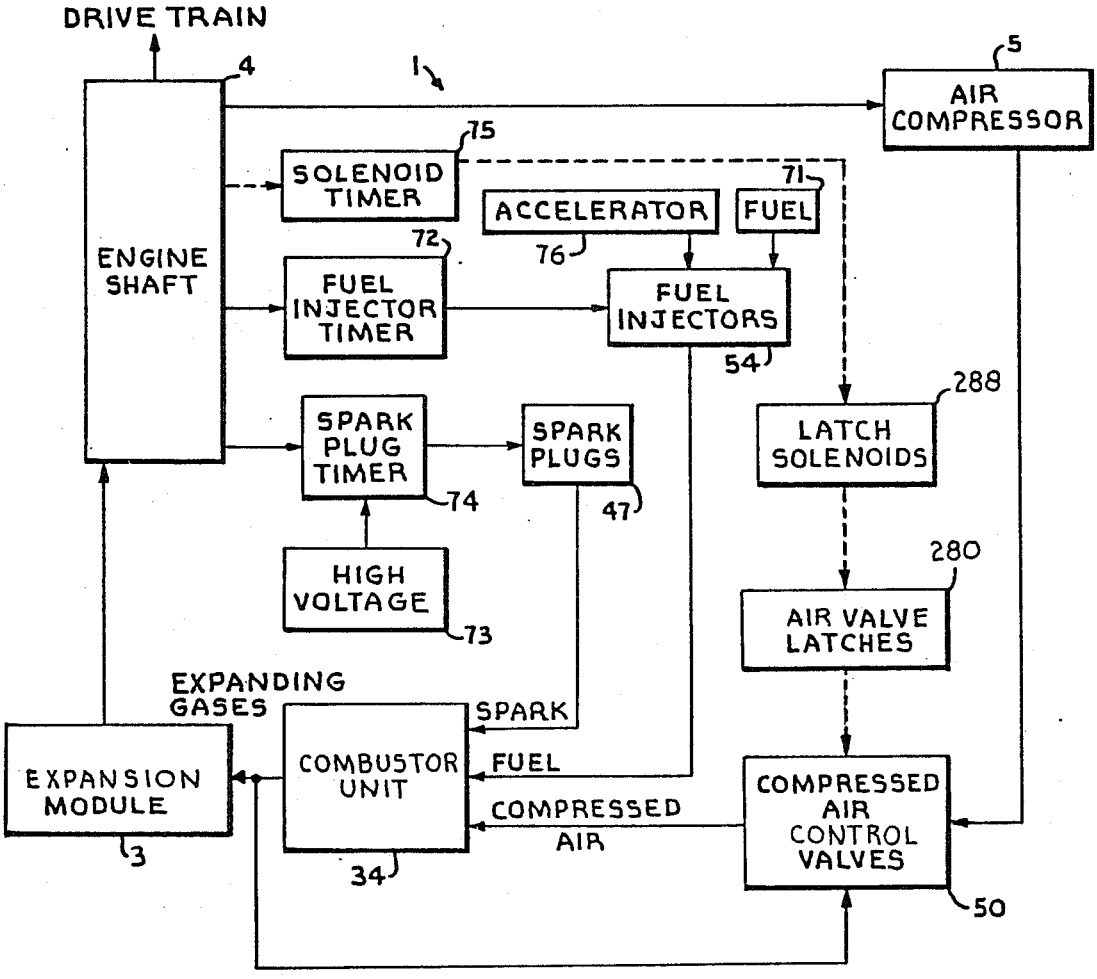
Fig. 2.

HINGE VALVED ROTARY ENGINE WITH SEPARATE COMPRESSION AND EXPANSION SECTIONS

CROSS-REFERENCE TO RELATED APPLICATIONS

This application is a continuation-in-part of application Ser. No. 045,153, filed Apr. 30, 1987, for COMBUSTION ENGINE HAVING FUEL CUT-OFF AT IDLE SPEED AND COMPRESSED AIR STARTING AND METHOD OF OPERATION, now U.S. Pat. No. 4,741,164, which is a continuation of application Ser. No. 787,677, filed Oct. 15, 1985, for EXTERNAL COMPRESSION ROTARY ENGINE, abandoned.

FIELD OF THE INVENTION

The present invention relates to rotary internal combustion engines and, more particularly, to such an engine employing separate intake/compression and exhaust/expansion chambers with respective, smooth surfaced rotors therein and hinged valves engaging the surfaces of the rotors to compress air in the intake/compression chamber and communicate a combustion charge to the exhaust/expansion rotor in the expansion chamber.

BACKGROUND OF THE INVENTION

Conventional reciprocating piston internal combustion engines are very complex mechanisms employing a great many parts which are subject to wear and which contribute to losses of efficiency due to friction. The reciprocating motion of the pistons cause vibrations which needlessly absorb input energy, create inertia and contribute to the failure of components of such engines and structures to which they are attached. While some improvements have been made in the effort to optimize the efficiency of piston engines, there is a fixed upper limit to the thermal efficiency of the piston engine concept which will forever limit its ability to realize more than a thermal efficiency of approximately thirty percent in production engines.

The thermal efficiency of an Otto cycle engine, such as internal combustion piston engines, is related to the expansion ratio of the engine, which is the ratio of the swept volume plus the head space volume of the cylinder to the head space volume. In a conventional piston engine, the expansion ratio is equal to the compression ratio of the engine, since compression and expansion occur in the same cylinder with the same volume sweeps by the piston. For a fuel with a given octane rating, the compression ratio must be limited to a value below which compression induced ignition or knock occurs too early in the compression cycle. In order to increase the thermal efficiency of a piston engine, it is necessary to increase the compression ratio, to thereby increase the expansion ratio, which requires a higher octane rating of the fuel at greater expense.

There are energy losses in piston engines due to the necessity of reversing the direction of linear motion of the pistons and the conversion of the linear motion to rotary motion. The expansion stroke of a piston engine occurs when the piston is just passing top dead center and when the piston rod and the crank throw of the crankshaft are almost aligned. Although the pressure within the cylinder is at a maximum at this time and the force available from the piston is greatest, the moment arm of the crankshaft throw is at a minimum. Thus, only a small component of piston force is available to the crankshaft to cause rotation. The remaining component of piston force is directed radially to the crankshaft and is wasted as heat to atmosphere. When the crankshaft is in an angular position such that the moment provided by the crank throw :s maximized, the cylinder pressure and the piston force resulting therefrom have diminished to less than half of that originally available resulting, with other inefficiencies of the piston engine concept, in unacceptably low thermal and mechanical efficiency.

In general, gas turbine engines, a form of rotary engine, have been applied most successfully to aircraft propulsion as fairly large engines. While a few small engines have been built and tested in passenger car size ground vehicles, the disadvantages of small gas turbine engines have outweighed the advantages. Maintenance of such engines is more expensive than for a comparable size piston engine. Additionally, the engine power relative to engine speed range is narrower for gas turbine engines whereby ground vehicles would require more complex and thus more expensive transmissions than are needed for piston engine driven cars.

The only well-known rotary engine which has achieved any degree of success in ground vehicles is the Wankel rotary internal combustion engine. But this engine is even less fuel efficient than the standard four cycle piston engine. The Wankel rotary engine has been applied with some success to smaller ground vehicles, such as automobiles and motorcycles. While the major component of motion of the Wankel rotor is, as its name implies, rotary, there is additionally a reciprocating component since the housing cavity in axial cross section is elongated rather than circularly cylindrical. The reciprocating component of rotor motion is a consequence of the geometry of the rotor and housing, the manner of gearing the rotor to the engine shaft, and the manner in which the fuel-air mixture is compressed and exhausted after combustion. This causes some loss of efficiency since energy must be expended in accelerating and decelerating the rotor through its linear components of motion. Additionally, Wankel engines have identical compression and expansion ratios such that the thermal efficiency of a Wankel engine is limited by the compression ratio possible with the fuel utilized, in the same manner as piston engines.

SUMMARY OF THE INVENTION

The present invention provides a rotary internal combustion engine employing separate compression and expansion chambers with respective compression and expansion rotors therein. The compressed air is communicated through a pressure actuated compressed air control valve to a combustion chamber or combustor unit wherein the compressed air is mixed with fuel from a fuel injector and ignited. The combustor unit communicates the expanding combustion gases to the expansion chamber to cause rotation of the rotor through a hinged combustion valve which, upon opening, sealingly engages the peripheral surface of the rotor and divides a portion of the expansion chamber into an active expansion chamber on one side of the combustion valve and an exhaust volume on the other side. The compression and expansion rotors are keyed to the engine shaft and move in a strictly rotary manner with no linear reciprocating component thereby eliminating that component of inefficiency suffered by a piston engine.

Each of the rotors of an engine embodying the present invention has two lobes which sealingly contact the peripheral cylindrical surface of the respective chamber. The rotors are each configured such that the remaining volumes of the chamber not occupied by the rotor are substantially crescent shaped. The crescent shaped volumes are divided into intake and compression volumes in the compression chamber by compression valves and into expansion and exhaust volumes in the expansion chamber by combustion valves.

The compressed air control valve in the combustor unit closes the combustor unit during the initial ignition of the fuel/air mixture. The air control valve is opened by the the combination of timing and the influx of compressed air and is resiliently urged to a closed position by a spring. When the fuel-air mixture is ignited, the combustion pressure causes the air control valve to positively seat thereby closing and preventing combustion gases under pressure from entering the compression section. Preferably, the air control valve is locked in the seated position and released by a timed solenoid operated latch. The preferred configuration for the air control valve includes a cylindrical shaft extending across the combustor unit with an air control valve vane extending tangentially from the cylindrical shaft.

The compression and expansion rotors are similar in shape and have substantially smooth or continuous surfaces which sealingly engage the walls of their respective chambers. The expansion rotor has pivotal rotor lobe seals, each including a cylindrical pivot base extending through the rotor lobe parallel to the rotary axis of the rotor, a sealing vane extending tangentially from the pivot base in a direction opposite the direction of rotation of the rotor, and springs between the rotor and the sealing vane to urge the vane outward. The sealing vane has an outer contact surface to engage the cylindrical surface of the expansion chamber and an inner pressure surface. Because of the orientation of the sealing vane on the trailing side of the pivot base, it is urged radially outward by centrifugal force, and it is exposed to pressurized gases within the expansion chamber which further urges the sealing vane into sealing engagement with the cylindrical surface of the expansion chamber.

There are two combustor units per set of compression and expansion sections. Because of this, with two lobed rotors, there are four combustion cycles per revolution of the engine shaft. In a preferred engine, there are two sets of compression and expansion sections with the respective compression rotors and expansion rotors oriented at ninety degrees to one another.

Since the compression and expansion sections are separate, it is possible to configure the compression ratio and the expansion ratio of the respective sections independently. Thus, the compression section can be configured for a compression ratio for a fuel with a given octane rating to prevent undesired combustion induced ignition of the fuel air mixture. Similarly, the expansion section can be configured for an expansion ratio to achieve optimum thermal efficiency.

OBJECTS OF THE INVENTION

The principal objects of the present invention are: to provide a greatly improved internal combustion engine; to provide an engine of greatly improved efficiency, higher output power to weight ratio and improved torque capabilities; to provide such an engine which avoids the reciprocation of relatively large masses therein and avoids the unnecessary step of conversion of the linear movement to rotary action thereby improving fuel efficiency and reducing vibrations; to provide such an engine having fewer parts and which does not require the complex type of valve mechanisms which are required in conventional reciprocating engines; to provide a rotary engine including a lobed expansion rotor positioned in a expansion module chamber and a compression rotor in a separate compression module chamber; to provide such an engine wherein air is compressed into a combustor unit for mixture with a fuel and ignition of the mixture to rotate the engine shaft upon the communication of the expanding charge to the expansion rotor; to provide such an engine employing a multiplicity of compression and expansion modules to increase the power output of the engine; to provide such an engine employing rotors having substantially smooth or continuous peripheral surfaces; to provide such an engine including hinged compression valves between the combustor units and the compression chambers, the compression valves being resiliently urged into contact with the peripheral surface of the compression rotor to divide crescent shaped volumes within the compression chamber respectively into intake volumes and active compression volumes; to provide such an engine including hinged combustion valves between the combustor units and the expansion chamber which are urged by combustion pressure into engagement with the peripheral surface of the expansion rotor to divide crescent shaped volumes within the expansion chamber into active expansion volumes and exhaust volumes; to provide such an engine wherein each combustor unit includes a compressed air control valve including a cylindrical shaft with a tangential air control valve vane extending from the shaft, the air control valve being resiliently urged to block a combustor passage to prevent the leakage of combustion gases into the compression chamber and of compressed air into the combustor unit; to provide such an engine wherein the lobes of the expansion rotor include lobe seals, each including a cylindrical pivot base pivotally mounted in the rotor lobe and a sealing vane extending tangentially from the pivot base toward the trailing side of the lobe, the rotor seal being resiliently urged to engage a contact surface of the sealing vane with the cylindrical surface of the expansion chamber and exposing a pressure surface of the sealing vane to pressurized gases within the expansion chamber to further urge the sealing vane into contact with the cylindrical surface; to provide such an engine which is configured for an optimum compression ratio for the octane rating of the fuel employed and wherein the expansion ratio of the expansion section is independently configured for an expansion ratio of optimum thermal efficiency; and to provide such a rotary engine which is economical to manufacture, efficient and durable in operation, and which is particularly well adapted for its intended purpose.

Other objects and advantages of this invention will become apparent from the following description taken in conjunction with the accompanying drawings wherein are set forth, by way of illustration and example, certain embodiments of this invention.

The drawings constitute a part of this specification and include exemplary embodiments of the present invention and illustrate various objects and features thereof.

BRIEF DESCRIPTION OF THE DRAWINGS

FIG. 1 is a side elevational view of a hinge valved rotary engine with separate compression and expansion sections embodying the present invention.

FIG. 2 is a block diagram illustrating the operation of the rotary engine.

DETAILED DESCRIPTION OF THE INVENTION

Figure 3:
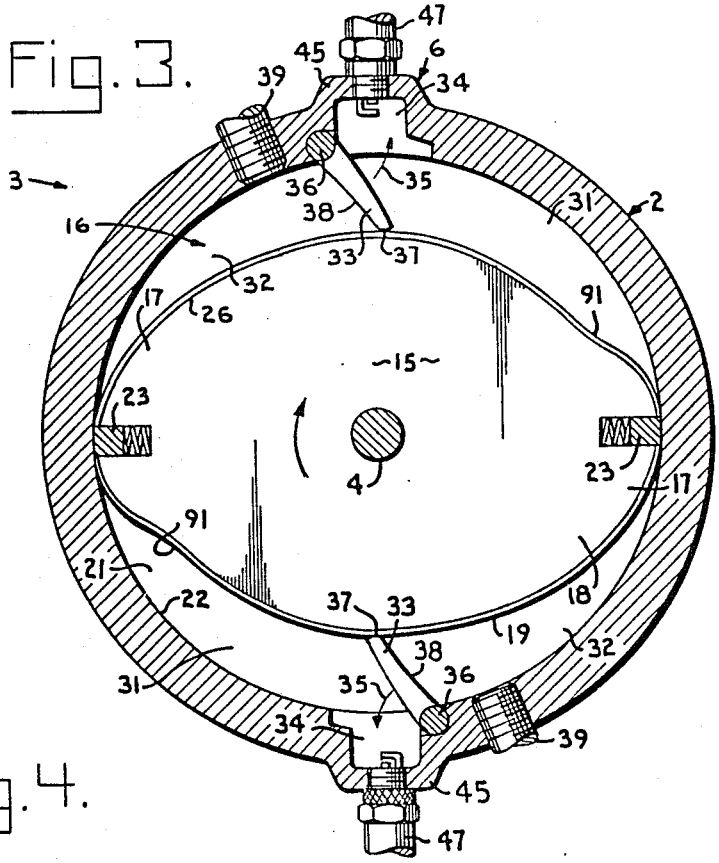
FIG. 3 is an enlarged transverse sectional view of an expansion module of the rotary engine.
Figure 4:
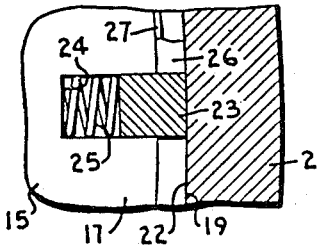
FIG. 4 is a greatly enlarged transverse sectional view of a portion of an expansion module and illustrates details of one embodiment of an expansion rotor lobe seal.

As required, detailed embodiments of the present invention are disclosed herein; however, it is to be understood that the disclosed embodiments are merely exemplary of the invention which may be embodied in various forms. Therefore, specific structural and functional details disclosed herein are not to be interpreted as limiting, but merely as a basis for the claims and as a representative basis for teaching one skilled in the art to variously employ the present invention in virtually any appropriately detailed structure.

Referring to the drawings in more detail:

The reference numeral 1 generally designates a hinge valved rotary engine with separate compression and expansion sections, embodying the present invention. The engine 1 generally includes an engine housing 2 which encloses at least one rotary expansion module 3 operative to cause the rotation of an engine shaft 4. A compression module 5 is also enclosed by the housing 2 and is operated by the rotation of the shaft 4 to intake and compress air for mixture with a fuel. Ignition of the fuel-air mixture in combustor units 6 generates combustion gases, the pressure of which causes rotation of the engine shaft 4 by communication thereof into the expansion module 3.

Referring to FIG. 3, the engine shaft 4 is rotatably mounted through the housing 2 as in bearing units (not shown). Each combustion unit 3 generally includes a lobed expansion rotor 15 positioned in a cylindrical expansion chamber 16 in the housing 2 and keyed or otherwise nonrotatably attached to the engine shaft 4. The illustrated expansionn rotor 15 has two lobes 17 on opposite sides of the shaft 4. The rotor 15 has flat end faces or base surfaces 18 on opposite sides thereof and a smooth and continuous peripheral surface 19. The expansion chamber 16 has opposite base surfaces 21 and a cylindrical peripheral surface 22.

Gas sealing between the lobes 17 of the rotor 15 and the cylindrical surface 22 of the expansion chamber 16 is maintained by rotor apex seals, simplified embodiments of which are indicated at 23, which are positioned in apex seal grooves 24 extending across the surface 19 of the lobes 17. The seals 23 are resiliently urged toward the surface 22 by apex seal springs 25. Sealing between the end faces 18 of the illustrated rotor 15 and the base surfaces 21 of the cavity 16 is maintained by end face seals 26 positioned in end face seal grooves. The seals 26 extend from apex seal to apex seal. Alternatively, other means for sealing between the rotor 15 and the surfaces of the expansion chamber 16 are foreseen.

The illustrated rotor 15 is of a somewhat distorted elliptical shape in radial cross-section and defines crescent or C-shaped volumes 29 (see FIG. 6) between the cylindrical surface 22 of the chamber 16 and the peripheral surface 19 of the rotor. Each of the chambers 29 is operationally divided into an active expansion chamber or expansion chamber proper 31 and an exhaust chamber 32 by a hinged combustion valve 33. The combustion valves 33 control the communication of gases between firing chambers 34 of the combustor units 6 and the expansion chambers 31. The firing chamber valves 33 may be resiliently urged to closed positions by combustion valve springs 35 (represented b arrows 35 in the figures) engaged between hinge shafts 36 of the valves 33 and the housing 2. Each combustion valve 33 has an outer edge 37 which sealingly contacts the peripheral surface 19 of the rotor 15. An outer surface 38 (with respect to the combustor unit 6) of each valve 33 on the expansion chamber side thereof is cylindrical and of the same radius as the expansion chamber 16 to form a continuation thereof when the valve 33 is closed.

Each of the exhaust chambers 32 communicates with an exhaust port 39 for exhausting expanded combustion gases from the expansion chamber 16. The exhaust ports 39 must be large enough to prevent substantial back pressure on the rotor 15 to avoid losses in efficiency. The combustion valves 33 are urged against the peripheral surface 19 of the expansion rotor 15 by the pressure of the combustion gases within the combustor unit 6. The combustion valves 33 fit snugly into their openings into the combustor units 6. The free ends of the combustion valves 33 are preferably slightly thicker than the openings in the combustor units 6 which receive them to prevent engagement of the edges of the openings by the seals 23. Alternatively, the rotor lobe seals 23 may be slightly longer than the width of the combustion valves 33 to avoid the possibility of the seals 23 slipping into the openings and being damaged thereby.

The combustor units 6 are operative to form a mixture of fuel and compressed air, ignite the mixture, and communicate the combustion gases to the active expansion chambers 31 to cause rotation of the rotor 15 and thus the engine shaft 4. Each combustor unit 6 includes a combustor unit wall 45 (FIG. 3) which forms the firing chamber 34 thereof. The wall 45 may be integral with the housing 2 or may be a separate structure which is bolted or otherwise attached to the housing 2 along with a sealing gasket (not shown) as needed.

The firing chamber 34 has the electrodes of an ignitor such as a spark plug 47 (FIG. 2) positioned therein for igniting the fuel-air mixture therein. The electrodes are preferably positioned to cause the most efficient combustion of the mixture. Compressed air is received into the firing chamber 34 from a compression module 5 or compression section 8 through compressed air control valve 50 (FIG. 2). A nozzle of a fuel injector 54 (FIG. 2) is positioned in the firing chamber 34 and delivers fuel thereinto. During combustion of the fuel-air mixture in the firing chamber 34, the pressure of the combustion gases exceeds the pressure of the compressed air such that the air control valve 50 is tightly seated to close the firing chamber 34 during ignition of the fuel-/air mixture therein.

The diagram in FIG. 2 generally illustrates the operation of the engine 1. The compression module 5 is driven by the engine shaft 4 to provide compressed air by way of the air control valves 50 to the firing chambers 34. Fuel from a fuel tank 71 is provided to the firing chambers 34 by the fuel injectors 54 as timed by a fuel injector timer 72. Current from a high voltage source 73 is distributed to the spark plugs 47 by a spark plug timer 74 to ignite the fuel-air mixture with.:n the firing chambers 34. The expanding gases of combustion are communicated to the expansion modules 3 to cause rotation of the rotors 15 thereby causing rotation of the engine shaft 4.

The fuel injector timer 72, spark plug timer 74, and solenoid timer 75 are illustrated as being ultimately controlled by the position of the engine shaft 4 and an accelerator 76. These timers may be any suitable type of individual or collective timers such as the type of electromechanical timers employed in conventional spark distributors or may be embodied as a digital computer which monitors and controls other functions of the engine 1 or a vehicle or system of which the engine 1 is a component. The engine shaft position may be sensed by conventional types of shaft encoders. In some respects, the control of the timing of engine functions by a computer is more versatile than electromechanical timing devices since the controller may be programmed to vary the timing of functions to optimize operation at varying temperatures and atmospheric pressures, engine temperatures, engine speeds, and the like.

Figure 6:
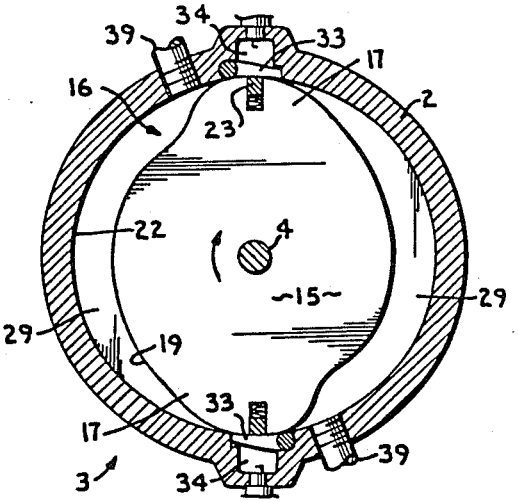
FIG. 6 is a transverse sectional view at a reduced scale of a two lobed embodiment of the expansion rotor at about the moment of ignition of the fuel mixture.
Figure 7:
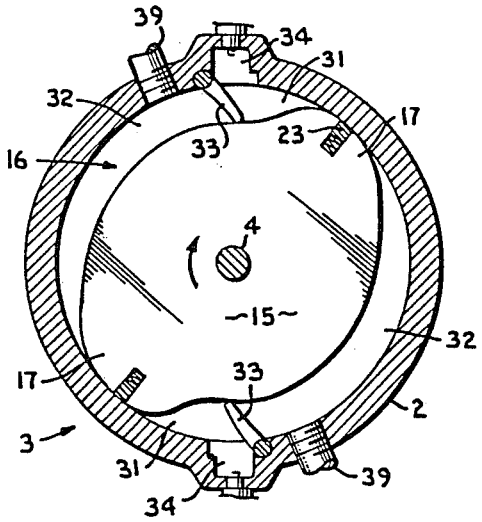
FIG. 7 is a view similar to FIG. 6 and shows the position of the expansion rotor undergoing an expansion stroke.

In FIG. 6 the expansion rotor 15 is shown at an approximate position just prior to ignition of the fuel-air mixture. The rotor 15 is just beginning to force the previously expanded combustion gases out the exhaust ports 39. At this position, the combustion valves 33 are held closed against the incoming compressed air and combustion pressure by the lobes 17 of the rotor 15. It is preferred that at least two expansion modules 3 be positioned on the engine shaft 4 and rotationally phased about ninety degrees from one another. In this way the firing of the rotors is staggered and operation is smoother since the expansion pulses are distributed over the engine shaft rotation cycle. FIG. 7 shows the position of the rotor 15 after ignition of the mixture, and the combustion valves 33 have been opened to maintain sealing contact with the rotor 15 by combustion pressures. At the same time, rotation of the rotor 15 causes the expulsion of the expended combustion gases from the previous combustion stroke out the exhaust ports 39.

Figure 8:
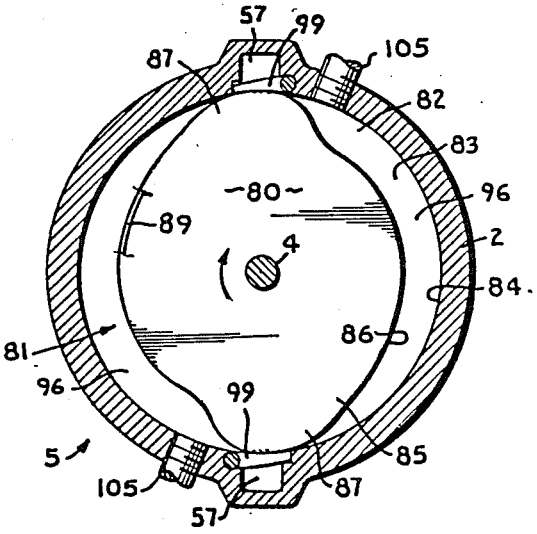
FIG. 8 is a view similar to FIG. 6 and shows an embodiment of a rotary compression module with the compression rotor just completing a compression stroke and just prior to starting another compression stroke, both chambers being filled with air as a result of completion of an intake stroke.
Figure 9:
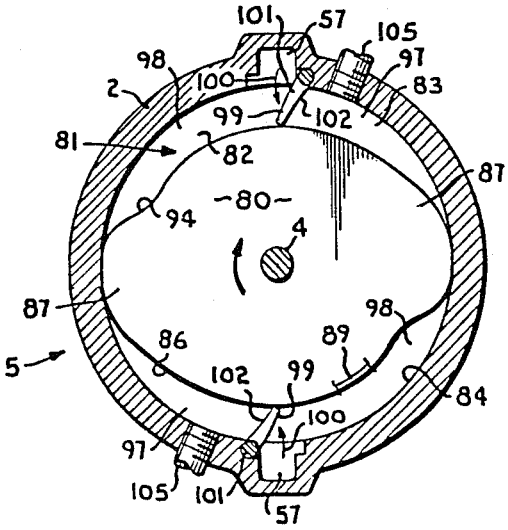
FIG. 9 is a view similar to FIG. 8 and shows the position of the compression rotor essentially halfway through the intake cycle and the compression cycle in each chamber.

FIGS. 8 and 9 illustrate a rotary compression module 5 which is suitable for use in the rotary engine 1. The compression module 5 includes a compression rotor 80 keyed or otherwise attached to the engine shaft 4 and positioned in a cylindrical compression chamber 81. The compression chamber 81 is separated from the expansion chamber 16 by a partition 82. The compression chamber 81 includes a pair of opposed base surfaces 83 and a peripheral cylindrical surface 84. The rotor 80 has opposite end face or base surfaces 85 and a smooth or continuous peripheral surface 86. The compression rotor 80 has two opposite lobes 87 positioned for a substantially sealing relationship with the cylindrical surface 84 of the compression chamber 81. The end faces 85 of the rotor 80 are sealed against the base surfaces 83 of the compression chamber 81 by end face seals 89 (only fragments of which are shown) which are similar to the end face seals 26 of the expansion rotor 15.

The illustrated compression rotor 80 is similar in shape to the shape of the expansion rotor 15 except that the rotors 80 and 15 are substantially mirror images of one another. The expansion rotor 15 has depressions 91 (FIG. 3) in the peripheral surface 19 thereof on the trailing side (for the clockwise motion indicated) of the lobes 17 to control the position of the combustion valves 33 and the speed at which they are allowed to open relative to the rotational speed of the rotor 15. Additionally, the shape of the surfaces of the depressions 91 allows the combustion valves 33 to effectively force the rotor 15 around in the earliest stages of opening of the valves 33 by pressure of the combustion gases on the valves 33. In contrast, the compression rotor 80 has depressions 94 in the peripheral surface 86 on the leading side of the lobes 87 for a similar purpose as will be explained below.

The compression rotor 80 forms crescent or C-shaped volumes 96 (FIG. 8) in the compression chamber 81 which are sealingly divided into an intake chamber 97 and an active compression chamber or compression chamber proper 98 (FIG. 9) by hinged compression valves 99. The valves 99 control gas communication between the compression chamber 81 and compressed air chambers 57 leading into the combustor units 6 and are similar in many respects to the combustion valves 33 of the expansion module 3, except that they are oppositely hinged. The valves 99 are resiliently urged to opened positions by springs 100 (represented by arrows 100, FIG. 9) which act between the housing 2 and pivot shafts 101 of the valves 99. The surfaces 102 of the valves 99 on the compression chamber side thereof are cylindrical and of the same radius as the cylindrical surface 84 of the chamber 81 and form a continuation thereof in the closed positions of the valves 99. The shape of the compression rotor lobes 87 as determined by the depressions 94 therein control the speed at which the valves 99 are closed by rotation of the compression rotor 80.

The intake chambers 97 receive air through air intake ports or inlets 105 as the rotor 80 rotates in a clockwise direction (as viewed in the figures) and forces the air into the compressed air chambers 57 of the combustor units 6 in timed relationship with the operation of the combustion module 3. The air inlets 105 may include air filters (not shown). The valves 99 seal against the bases surfaces 83 of the compression chamber 81 and the peripheral surface 86 of the rotor 80. The angular relationship between the combustion rotor 15 and the compression rotor 80 depends on factors of engine operation and would likely be about thirty to forty degrees with the expansion rotor 15 leading.

It is preferred that each expansion module 3 be paired with its own compression module 5 in order to be coordinated with the compression cycle and to develop the highest fuel efficiency. However, the compressed air can be diverted through a compressed air reservoir tank (not shown) for purposes such as air brakes, compressed air starting, or the like. The capacity of the rotary compression module 5 can be increased by increasing the axial depths of the compression cavity 81 and the rotor 80. Increases in capacity can also be accomplished by increasing the radius of the compression cavity and rotor and by altering the peripheral contour of the compression rotor 80. Alterations to the geometric parameters of the compression module 5 and combustor unit 6 can also affect the effective compression ratio of the engine 1 as might be required depending on the type of fuel employed.

Figure 5:
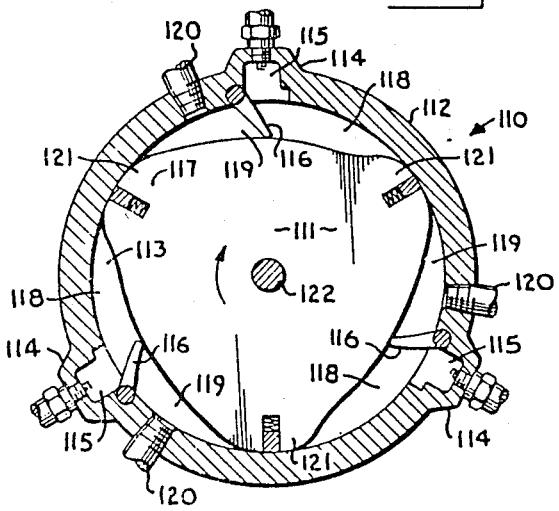
FIG. 5 is a transverse sectional view at a reduced scale of a three lobed embodiment of the expansion module.

FIG. 5 illustrates a modified expansion module 110 according to the present invention which employs a three lobed rotor 111. A housing 112 forms a cylindrical expansion chamber 113 in which the rotor 111 is sealingly positioned. Three combustor units 114 are spaced evenly about the expansion chamber 113, and each includes a firing chamber 115 in which a combustible mixture of fuel and compressed air is ignited to cause rotation of the rotor 111. The firing chambers 115 communicate with the expansion chamber 113 through respective firing chamber valves 116 which are forced into sealing contact with the peripheral surface 117 of the rotor 111 by the force of combustion pressure. The valve 116 divide crescent shaped volumes of the expansion chamber 113 which are not occupied by the rotor 111 into active expansion chambers 118 and exhaust chambers 119 which communicate with exhaust ports 120.

The modified expansion rotor 111 has three lobes 121 which are evenly spaced thereabout. The rotor 111 is keyed to an engine shaft 122 and is operative to rotate same in response to the communication of expanding combustion gases from the firing chambers 115 into the active expansion chambers 118. The modified expansion module 110 operates in substantially the same manner as the combustion module 3 except for the timing of the cycles to accommodate the increase in the number of firing cycles per revolution of the engine shaft 122. A compression module (not shown) for feeding compressed air to the combustor units 114 would be substantially similar to the expansion module except for analogous differences between the expansion module 3 and compression module 5 and a difference in timing. Alternatively, expansion and compression modules with rotors having a number of lobes greater than three could be embodied according to the present invention. However, there is a point of diminishing returns in increasing the number of rotor lobes and combustor units as far as engine simplicity and efficiency are concerned.

Further details of the engines 1 and 110 are available in copending application Ser. No. 045,153 (now U.S. Pat. No. 4,741,164) which is incorporated herein by reference.

FIGS. 10–15 illustrate a preferred embodiment 200 of the rotary engine according to the present invention. The engine 200 includes a housing 201 formed by a pair of housing halves 202 and 203 connected by combustor unit assemblies 204. The ends of the housing 201 are closed by end plates 205. The housing 201 is divided internally into a compression chamber 206 and an expansion chamber 207 by annular partitions 208. The end plates 205 have bearings 209 therein in which an engine shaft 210 is rotatably mounted for rotation about a rotary axis. A compression rotor 211 is keyed to the shaft 210 within the compression chamber 206, and an expansion rotor 212 is similarly keyed to the shaft 210 within the expansion chamber 207. Shaft seals 213 are mounted on the end plates 205 and sealingly engage the engine shaft 210. Lubricant passages 214 are provided between the inner partitions 208 and between the outer partitions 208 and the end plates 205. An engine lubricant is placed in the passages 214 to lubricate the moving parts of the engine 200.

Figures 12, 13, 14, 15:
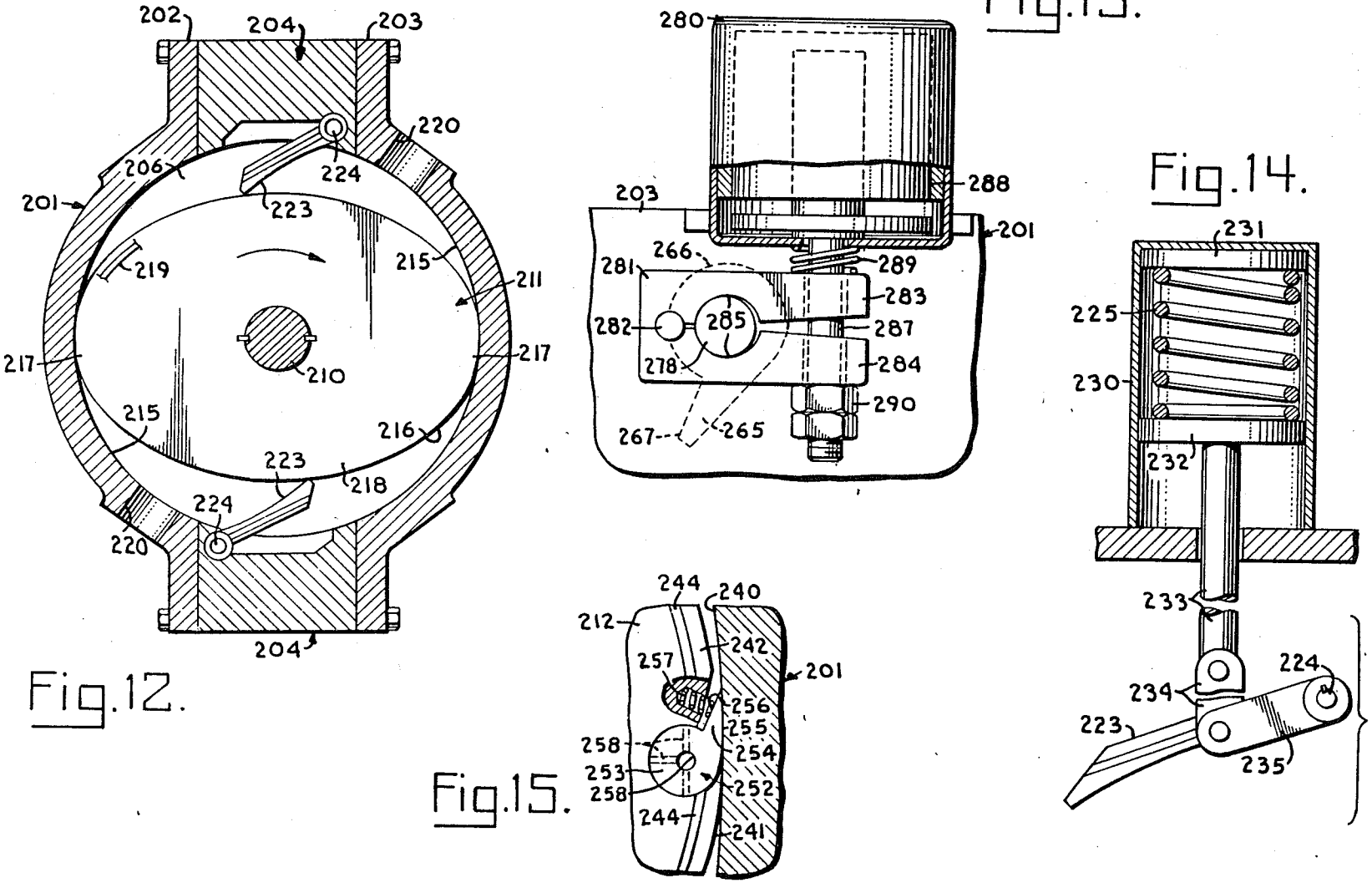
FIG. 12 is a transverse sectional view of the preferred embodiment of the rotary engine taken on line 12—12 of FIG. 10 and illustrates a compression module thereof.
FIG. 13 is a side elevational view at a further enlarged scale of a solenoid and brake arrangement for locking an air control valve of a combustor unit of the preferred embodiment of the rotary engine in a closed position.
FIG. 14 is a diagrammatic sectional view of a compression valve bias spring arrangement for the preferred embodiment of the rotary engine.
FIG. 15 is a greatly enlarged transverse sectional view of an expansion rotor lobe of the preferred embodiment of the rotary engine and illustrates details of a preferred expansion rotor lobe seal.

Referring to FIG. 12, the compression chamber 206 includes an inner cylindrical surface 215 against which the compression rotor 211 is sealed. The illustrated compression rotor 211 has an elliptical peripheral surface 216 and a pair of opposite compression rotor lobes 217 which form a substantially sealing relationship with the cylindrical surface 215. The compression rotor 211 has opposite end faces 218 which, in cooperation with end face seals 219, seal against the partitions 208. A pair of intake ports 220 communicate with the compression chamber 206 and supply air thereto for compression. Compression valves 223 are hingedly mounted by compression valve shafts 224 to the combustor unit assemblies 204 and are urged by compression valve bias springs 225 (FIG. 14) into sealing engagement with the peripheral surface 216 of the compression rotor 211. As the shaft 210 and compression rotor 211 are rotated, air is taken into the compression chamber 206 on one side of the compression valves 223 and compressed into a combustor passage 226 on the other side of the compression valve 223.

FIG. 14 illustrates details of the compression valve bias spring 225. The illustrated bias spring 225 is a compression spring and is encased within a spring housing 230 between a spring abutment 231 and a piston 232. The piston 232 has a rod 233 extending therefrom which is connected to the shaft 224 of the compression valve 223 by a link 234 and a crank arm 235. The spring housing 230 is mounted on a wall 236 of the combustor unit assembly 204 and the rod 233 extends through the wall 236. Alternatively, other arrangements may be employed to maintain sealing engagement between the compression valve 223 and the peripheral surface 216 of the compression rotor 211.

Figure 11:
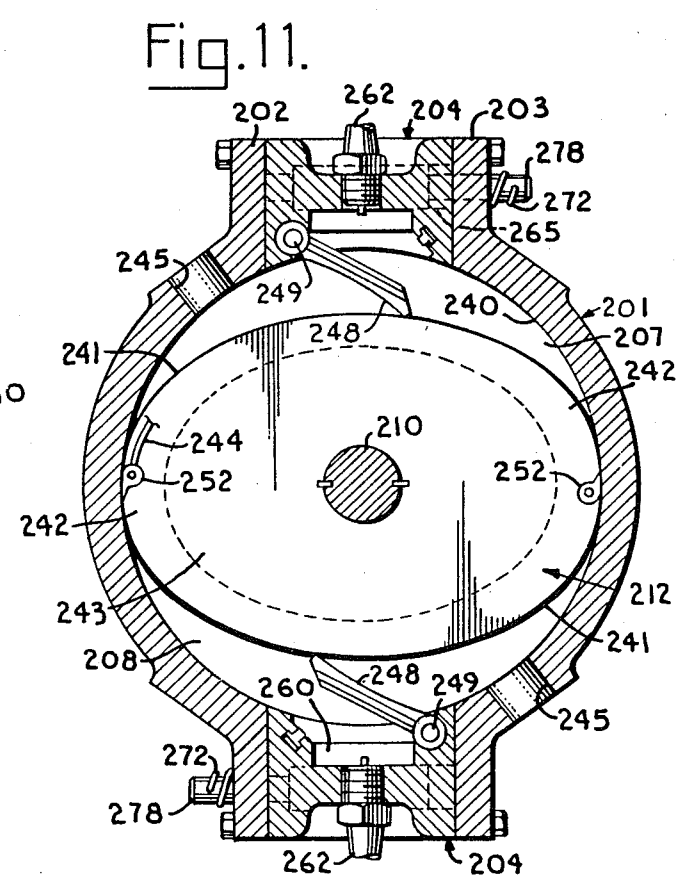
FIG. 11 is a transverse sectional view of the preferred embodiment of the rotary engine taken on line 11—11 of FIG. 10 and illustrates an expansion module thereof.

The expansion chamber 207 and expansion rotor 212 are substantially similar to the compression chamber 206 and compression rotor. Referring to FIG. 11, the expansion chamber 207 includes an inner cylindrical surface 240 against which the expansion rotor 212 is sealed. The illustrated expansion rotor 212 has an elliptical peripheral surface 241 and a pair of opposite expansion rotor lobes 242 which sealingly contact the cylindrical surface 240. The expansion rotor 212 has opposite end faces 243 which, in cooperation with end face seals 244, seal against the partitions 208. A pair of exhaust ports 245 communicate with the expansion chamber 207 and provide a means for exhausting combustion gases after expansion. Combustion valves 248 are hingedly mounted by combustion valve shafts 249 to the combustor unit assemblies 204 and are urged by the pressure of combustion gases into sealing engagement with the peripheral surface 241 of the expansion rotor 212. Combustion gases from the combustor unit assemblies 204 are communicated to the peripheral surface 241 of the expansion rotor 212 on one side of the combustion valves 248 to cause the expansion rotor 212, and the engine shaft 210, to rotate therewith. The previously expanded combustion gases are exhausted from the expansion chamber 207 through the exhaust ports 245 on the exhaust sides of the combustion valves 248.

FIG. 15 illustrates a preferred type of rotor lobe seal 252 for the expansion rotor 212. The seal 252 includes a cylindrical pivot base 253 which is pivotally mounted through the lobes 242 of the expansion rotor 212 near the peripheral surface 241. A sealing vane 254 extends substantially tangentially from the pivot base 253 in a direction opposite the direction of rotation of the expansion rotor 212. The sealing vane 254 has an outer contact surface 255 which engages the cylindrical surface 240 of the expansion chamber 207 and an opposite inner pressure surface 256.

Rotor lobe seal bias springs 257 are mounted in the rotor lobe 242 and engage the pressure surface 256 to urge the sealing vane 254 outward to cause engagement between the contact surface 255 and the cylindrical surface 240. Pivoting the sealing vane 254 outward additionally exposes the pressure surface 256 to the pressure of combustion gases in the expansion chamber 207 which, when present, further urge the sealing vane 254 outward for added sealing engagement. The pivot base 253 may be provided with lubricant passages 258 to distribute an engine lubricant to the surfaces of the lobe seal 252, to the rotor end seals 244 and to the cylindrical surface 240 of the expansion chamber 207.

Figure 10:
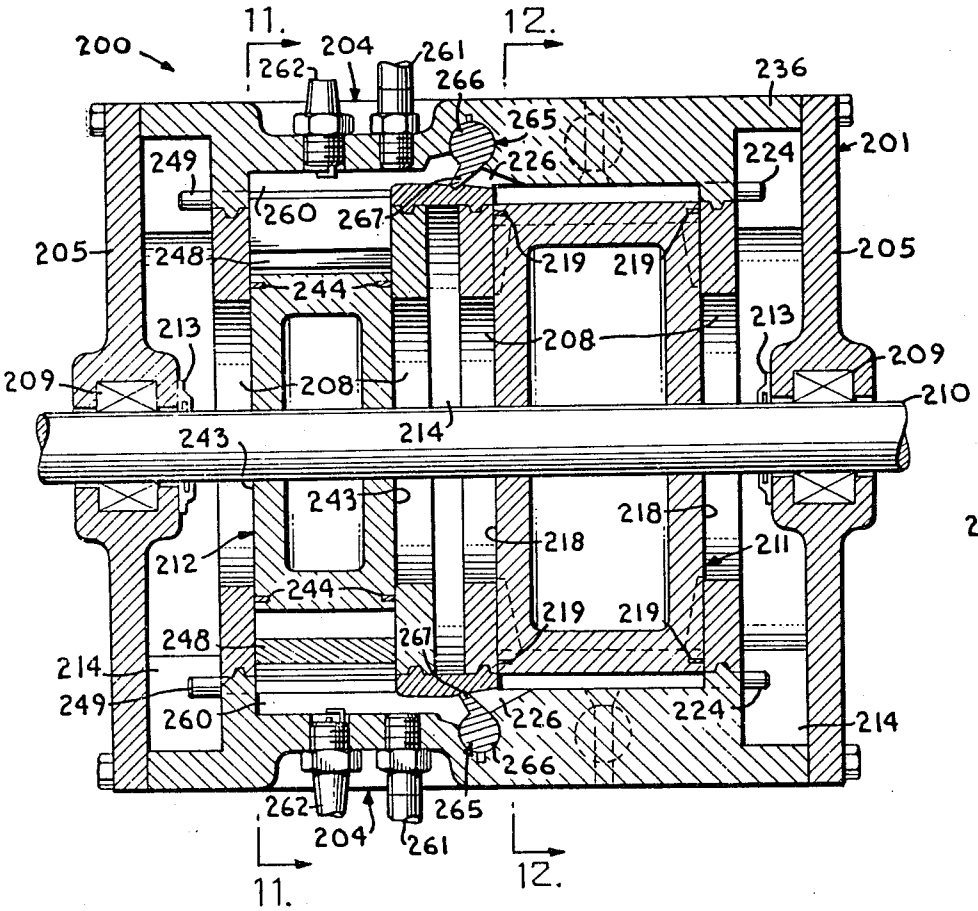
FIG. 10 is a longitudinal sectional view at an enlarged scale of a preferred embodiment of the rotary engine according to the present invention.

Referring to FIG. 10, the combustor unit assembly 204 has the combustor passage 226 formed therein and leading to a firing chamber 260 in which ignition of the fuel/air mixture occurs. A nozzle of a fuel injector 261 is positioned within the firing chamber 260 along with electrodes of a spark plug 262. The flow of compressed air into the firing chamber 260 is controlled by a compressed air gate valve or air control valve 265 which is urged to a closed position. The air control valve 265 is configured such that it is acted upon by both the pressure of combustion gases in the firing chamber 260 and the pressure of compressed air from the compression chamber 206.

When the pressure in the firing chamber 260 equals or exceeds that of the pressure of compressed air entering from the compression chamber 206, the air control valve 265 is urged to a closed position and is locked in the closed position. When the pressure of the compressed air from the compression chamber 206 exceeds that of the gases in the firing chamber 260 late in the expansion cycle, the air control valve 265 is timed to unlock to allow the compressed air into the firing chamber 260. The timing of activation of the fuel injector 261 and spark plug 262 are controlled in relation to the angle of the engine shaft 210, as is illustrated in FIG. 2.

The preferred air control valve 265 has a cylindrical shaft 266 which is pivotally mounted within and across the combustor unit assembly 204. An air control valve vane 267 extends substantially tangentially from the cylindrical shaft 266 and is the element of the air control valve 265 which blocks the combustor passage 226 in the closed position of the air control valve 265. A light force torsion spring 272 (FIG. 11) is positioned on an extension 278 of the air control valve shaft 266 and is engaged between the extension 278 and a part of the engine housing 201.

FIG. 13 illustrates an air control valve lock or latch mechanism 280. The lock mechanism 280 is provided to control the timing of the opening of the air control valve 265. The mechanism 280 includes a resilient bifurcated clamp 281 which is restrained with respect to the engine housing 201 by a pin 282. The clamp 281 has opposite legs in which is formed halves of an aperture 285 which encircles the extension 278 of the air control valve shaft 266. A rod 287 extends through the outer ends of the legs 283 and 284 and forms the core of an air control valve lock solenoid 288. A compression spring 289 is positioned between the leg 283, and an abutment nut 290 is positioned on an outer end of the rod 287. Upon activation of the solenoid 288, the rod 287 is drawn upward, as viewed, which draws the clamp legs 283 and 284 together, causing the surfaces of the aperture 285 to frictionally grip the shaft extension 278. The spring 289 causes the vane 267 of the air control valve 265 to more positively engage its seat within the combustor unit 204. Upon deactivation of the solenoid 288, the resilience of the legs 283 and 284 of the clamp 281 causes the rod 287 to be drawn out of the solenoid 288 allowing the legs 283 and 284 to separate, thus releasing the shaft extension 278 and allowing the main part of the valve shaft 266 to turn freely in the combustor unit assembly 204.

As viewed in FIGS. 11 and 12, the expansion chamber 207 and compression chamber 206 have the same cylindrical diameter. However, FIG. 10 illustrates the expansion rotor 212 and the compression rotor 211 as having different depths. The independence of the compression and expansion chambers 206 and 207 allows the engine 200 to be configured for independent and optimized compression and expansion ratios, in contrast to conventional piston and Wankel engines. Thus, an engine according to the present invention can be designed for an optimum compression ratio according to the octane rating of the fuel to be employed and for an expansion ratio which provides for the highest practical thermal efficiency and, thus, the optimum fuel economy.

The engines 1, 110, and 200 incorporate the advantages made possible in a genuine rotary engine arrangement such as simplicity of design, dramatic increase in horsepower to weight ratio, greatly improved thermal and mechanical efficiencies, improved fuel economy, decreased vibration, improved reliability, low initial operating and maintenance costs, and a multitude of other additional benefits. These engines have potential application in virtually every requirement for a fueled power unit from fractional horsepower to several thousand horsepower including ground vehicles and equipment, whether stationary or mobile, plus aircraft and marine applications and others.

It is to be understood that while certain forms of the present invention have been illustrated and described herein, it is not to be limited to the specific forms or arrangement of parts described and shown.

What is claimed and desired to be secured by Letters Patent is as follows:

1. A rotary combustion engine comprising:
(a) an engine housing;
(b) an engine shaft rotatably supported through said engine housing and having a rotary axis;
(c) positive displacement rotary compression means positioned within said housing, engaged with said shaft, and operative to compress air upon the rotation of said shaft, said compression means including a compression chamber;
(d) combustor means including a combustor passage communicating with said compression means to receive compressed air therefrom, mix a fuel therewith, and ignite a fuel/air mixture of said compressed air and fuel;
(e) a compression rotor affixed to said engine shaft and positioned within said compression chamber, said compression rotor having a continuous compression rotor surface and including a compression rotor lobe forming a substantially sealing relationship with compression chamber surface;
(f) a cylindrical expansion chamber formed within said housing coaxial with said rotary axis, said expansion chamber including a cylindrical expansion chamber surface;
(g) an exhaust port communicating with said expansion chamber;
(h) an expansion rotor affixed to said engine shaft and positioned within said expansion chamber, said expansion rotor having a continuous expansion rotor surface and including an expansion rotor lobe sealingly engaging said expansion chamber surface;
(i) an expansion rotor lobe seal between said expansion rotor lobe and said expansion chamber surface, said expansion rotor lobe seal comprising:
(1) a cylindrical pivot base pivotally mounted through said expansion rotor lobe adjacent said expansion rotor surface and extending parallel to a rotary axis;
(2) a sealing vane extending substantially tangentially from said pivot base in a direction opposite an angular direction of rotation of said engine shaft, said sealing vane having an outer contact surface and an opposite inner pressure surface, said sealing vane being urged by centrifugal force to force said contact surface into sealing contact with said expansion chamber surface; and
(3) resilient means positioned between said vane and said rotor lobe to additionally urge said sealing vane outward from said rotary axis to engage said expansion rotor surface and to expose said pressure surface to pressure within said expansion chamber which further urges said contact into engagement with said expansion chamber surface; and
(j) air control valve means positioned in said combustor means and controlling the communication of compressed air between said compression chamber and said combustor means, said air control valve means including:
(1) a cylindrical shaft extending across said combustor means;
(2) an air control valve vane extending tangentially from said cylindrical shaft; and
(3) air control valve bias means engaged between said cylindrical shaft and said housing and urging said cylindrical shaft to move said air control valve vane to a position to close said combustor passage.

2. An engine as set forth in claim 1 wherein:
(a) said combustor means is a first combustor means, said intake port is a first intake port, and said exhaust port is a first exhaust port;
(b) said engine includes a second combustor means substantially identical to said first combustor means and positioned 180 degrees angularly about said rotary axis from said first combustor means;
(c) said engine includes a second intake port positioned 180 degrees angularly about said rotary axis from said first intake port; and
(d) said engine includes a second exhaust port positioned 180 degrees angularly about said rotary axis from said first exhaust port.

3. An engine as set forth in claim 1 wherein:
(a) said compression rotor has a pair of compression rotor lobes positioned in substantially 180 degree opposition across said rotary axis; and
(b) said expansion rotor has a pair of expansion rotor lobes positioned in substantially 180 degree opposition across said rotary axis.

4. An engine as set forth in claim 1 wherein
(a) said compression rotor surface is noncircularly elliptical about said rotary axis; and
(b) said expansion rotor surface is noncircularly elliptical about said rotary axis.

5. An engine as set forth in claim 1 wherein:
(a) said combustor means is a first combustor means, said intake port is a first intake port, and said exhaust port is a first exhaust port;
(b) said engine includes a second combustor means substantially identical to said first combustor means and positioned 180 degrees angularly about said rotary axis from said first combustor means;
(c) said engine includes a second intake port positioned 180 degrees angularly about said rotary axis from said first intake port;
(d) said engine includes a second exhaust port positioned 180 degrees angularly about said rotary axis from said first exhaust port;
(e) said compression rotor has a pair of compression rotor lobes positioned in substantially 180 degree opposition across said rotary axis; and
(f) said expansion rotor has a pair of expansion rotor lobes positioned in substantially 180 degree opposition across said rotary axis.

6. An engine as set forth in claim 1 wherein:
(a) said compression rotor has three compression rotor lobes positioned in substantially 120 degree opposition across said rotary axis; and
(b) said expansion rotor has three expansion rotor lobes positioned in substantially 120 degree opposition across said rotary axis.

7. An engine as set forth in claim 1 wherein:
(a) a first compression section is formed by said compression chamber, said intake port, said compression rotor, and said compression valve;
(b) said combustor means is a first combustor means;
(c) a first expansion section is formed by said expansion chamber, said exhaust port, said expansion rotor, and said combustor valve; and (d) said housing has positioned therein a second compression section including a second compression rotor driven by said shaft, a second expansion section including a second expansion rotor driving said shaft, and a second combustor means communicating between said second compression section and said second expansion section; said second compression section, said second combustor means, and said second expansion section being constructed and operating substantially the same as said first compression section, said first combustor means, and said first expansion section.

8. An engine as set forth in claim 1, wherein said air control valve means includes:

(a) air control valve lock means engaged with said cylindrical shaft and operable to lock said cylindrical shaft in a position such that said air control valve vane seals said combustion passage, said air control valve lock means including:

(1) an air control valve clamp positioned on said housing and releasably clamping said cylindrical shaft; and (2) an air control valve solenoid mounted on said housing and including an armature engaging said clamp such that said clampingly engages said cylindrical shaft when said solenoid is activated and releases said cylindrical shaft when said solenoid is deactivated.

9. A rotary engine comprising:

(a) an engine housing;

(b) an engine shaft rotatably supported through said engine housing, having a rotary axis, and rotating in a selected angular direction about said rotary axis;

(c) positive displacement rotary compression means positioned within said housing, including a compression rotor positioned on said shaft, and operative to compress air upon the rotation of said shaft;

(d) an intake port communicating air into said compression means;

(e) combustor means including a combustor passage communicating with said compression means to receive compressed air therefrom, mix a fuel therewith, and ignite a fuel/air mixture of said compressed air and fuel to form a combustion charge thereof;

(f) a cylindrical expansion chamber formed within said housing coaxial with said rotary axis, said expansion chamber including a cylindrical expansion chamber surface and communicating with said combustor means;

(g) an exhaust port communicating with said expansion chamber;

(h) an expansion rotor affixed to said engine shaft and positioned within said expansion chamber, said expansion rotor having a continuous expansion rotor surface and including an expansion rotor lobe sealingly engaging said expansion chamber surface;

(i) a compression valve hingedly connected to said housing at one end of said compression valve and having an opposite free end, said compression valve cooperating with said compression rotor to compress air into said combustor means;

(j) a combustor valve hingedly connected to said housing at one end of said combustor valve and having an opposite free end, said free end of said combustor valve being urged into sealing engagement with said expansion rotor surface by the pressure of an expanding combustion charge of said fuel/air mixture, said combustor valve cooperating with said expansion rotor to communicate said combustion charge to said expansion rotor surface to cause said expansion rotor to rotate by the expansion of said combustion charge;

(k) a rotor lobe seal to seal between said expansion rotor lobe and said expansion chamber surface, said seal including:

(1) a cylindrical pivot base pivotally mounted through said expansion rotor lobe adjacent said expansion rotor surface nd extending parallel to said rotary axis;

(2) a sealing vane extending substantially tangentially from said pivot base in a direction opposite said selected angular direction of rotation of said engine shaft, said sealing vane having an outer contact surface and an opposite inner pressure surface; and (3) resilient means positioned between said sealing vane and said expansion rotor lobe to urge said sealing vane outward from said rotary axis to engage said contact surface with said expansion chamber surface and to expose said pressure surface to pressure within said expansion chamber which further urges said contact surface into engagement with said expansion chamber surface; and (l) air control valve means positioned in said combustor means and controlling the communication of compressed air between said compression means and said combustor means, said air control valve means including:

(1) a cylindrical shaft extending across said combustor means;

(2) an air control valve vane extending tangentially from said cylindrical shaft; and (3) air control valve bias means engaged between said cylindrical shaft and said housing and urging said cylindrical shaft to move said air control valve vane to a position to close said combustor passage.

10. A rotary combustion engine comprising:

(a) an engine housing;

(b) an engine shaft rotatably supported through said engine housing and having a rotary axis;

(c) positive displacement rotary compressor means positioned within said housing, engaged with said shaft and operative to compress air upon the rotation of said shaft;

(d) combustor means including a combustor passage communicating with said compressor means to receive compressed air therefrom, mix a fuel therewith, and ignite a fuel/air mixture of said compressed air and fuel;

(e) positive displacement rotary expansion means positioned within said housing, engaged with said shaft, communicating with said combustor means, and operative to cause the rotation of said shaft upon the communication of an expanded fuel/air mixture ignited by said combustor means;

(f) air control valve means positioned in said combustor means and controlling the communication of compressed air between said compressor means and said combustor means, said air control valve means including:

(1) a cylindrical shaft extending across said combustor means;

(2) an air control valve vane extending tangentially from said cylindrical shaft; and (3) air control valve bias means engaged between said cylindrical shaft and said housing and urging said cylindrical shaft to move said air control valve vane to a position to close said combustor passage; and (g) said air control valve means including air control valve lock means engaged with said cylindrical shaft and operable to lock said cylindrical shaft in a position such that said air control valve vane seals said combustion passage, said air control valve lock means including:

(1) an air control valve clamp positioned on said housing and releasably clamping said cylindrical shaft; and (2) an air control valve solenoid mounted on said housing and including an armature engaging said clamp such that said clamp clampingly engages said cylindrical shaft when said solenoid is activated and releases said cylindrical shaft when said solenoid is deactivated.

* * * * *